US007021076B2

(12) United States Patent
Park et al.

(10) Patent No.: US 7,021,076 B2
(45) Date of Patent: Apr. 4, 2006

(54) UNIT TYPE AIR CONDITIONER

(75) Inventors: Jung Mee Park, Busan-si (KR); Woo Sung Chang, Changwon-si (KR)

(73) Assignee: LG Electronics Inc., Seoul (KR)

( * ) Notice: Subject to any disclaimer, the term of this patent is extended or adjusted under 35 U.S.C. 154(b) by 29 days.

(21) Appl. No.: 10/714,668

(22) Filed: Nov. 18, 2003

(65) Prior Publication Data

US 2005/0016194 A1 Jan. 27, 2005

(30) Foreign Application Priority Data

Jul. 22, 2003 (KR) ..... 10-2003-0050274
Jul. 22, 2003 (KR) ..... 10-2003-0050275

(51) Int. Cl.
*F25D 23/12* (2006.01)

(52) U.S. Cl. ..... 62/262; 62/298

(58) Field of Classification Search ..... 62/262, 62/298, 407, 263
See application file for complete search history.

(56) References Cited

U.S. PATENT DOCUMENTS 3,729,952 A * 5/1973 Macleod ..... 62/428
5,381,672 A * 1/1995 Haasis ..... 62/458
5,467,610 A * 11/1995 Bolton et al. ..... 62/262
5,638,693 A * 6/1997 Baek ..... 62/262
5,943,873 A * 8/1999 Chung ..... 62/262
6,182,460 B1 * 2/2001 Hernandez et al. ..... 62/262
6,412,298 B1 * 7/2002 Kang et al. ..... 62/262
6,460,363 B1 * 10/2002 Moretti et al. ..... 62/262
6,568,201 B1 * 5/2003 Cur et al. ..... 62/262
2003/0209024 A1 * 11/2003 Lee

* cited by examiner

*Primary Examiner*—William E. Tapolcai
(74) *Attorney, Agent, or Firm*—McKenna Long & Aldridge LLP

(57) ABSTRACT

Unit type air conditioner including a base plate forming a bottom part thereof, a barrier projected upward from a center part of the base plate, to divides the unit type air conditioner into an indoor part for mounting an indoor heat exchanger thereon and an outdoor part for mounting an outdoor heat exchanger thereon, a shroud for leading air drawn from an outdoor to the outdoor heat exchanger, the shroud dividing an inside of the outdoor part, exterior members including a cabinet surrounding opposite side parts and rear side part of he outdoor part, and a cover on the cabinet to form an upper exterior of the outdoor part, and a brace fastened to the barrier, the shroud, and the exterior members, for preventing relative positional change between the barrier, the shroud, and the external members, thereby fastening components rigidly, to enhance fastening strength.

16 Claims, 10 Drawing Sheets

UNIT TYPE AIR CONDITIONER

This application claims the benefit of the Korean Application Nos. P2003-0050274, and P2003-0050275, both filed on Jul. 22, 2003, which are hereby incorporated by reference.

BACKGROUND OF THE INVENTION

1. Field of the Invention

The present invention relates to a unit type air conditioner, and more particularly, to a unit type air conditioner for fastening components more rigidly, for enhancing fastening strength.

2. Background of the Related Art

In general, the unit type air conditioner, having an indoor part and an outdoor part provided within one unit, is installed in a window or the like of a building for air conditioning a space in the building.

FIG. 1 illustrates a perspective view of a related art unit type air conditioner, and FIG. 2 illustrates a disassembled perspective view of a related art unit type air conditioner.

Referring to FIG. 1 and 2, there is a base plate 10 in a bottom part of the air conditioner. The base plate 10, rectangular substantially, has a barrier 12 projected from a center of an upper surface thereof.

The barrier 12 divides the unit type air conditioner into an indoor part and an outdoor part. There is a frame form a front exterior of the air conditioner. The frame 14, formed of a plastic, has an air inlet 15 in a front surface thereof. The air inlet 15 has an inlet grill 16 fitted thereto for passing air drawn therein, and an air filter 17 in rear of the inlet grill 16.

In the meantime, there is a discharge opening 15*a* in an upper part of the frame 14, having a discharge grill 18 fitted thereto for passing air discharged from an inside of the air conditioner. The reference symbol 20 denotes a display part.

There is a cabinet 22 forming exteriors of a rear part and side parts of the air conditioner. The cabinet 22 has a plurality of openings 23 for inlet/outlet of air. The cabinet 22 is mounted on the base plate 10 and the frame 14.

There is a cover 26 on the cabinet 22, to form a top exterior of the outdoor part. The cover 26 has one end having a cover ledge 28 fastened to the frame 14.

An inside configuration of the unit type air conditioner divided into the indoor part and the outdoor part by the barrier 12 will be described.

In the indoor part, there is an indoor heat exchanger 30 in rear of the frame 14. The indoor heat exchanger 30 makes the air drawn from the room to heat exchange with a working fluid in a heat exchange cycle.

The indoor heat exchanger 30 joins with an air guide 32 having an upper air guide 32*u* and a lower air guide 32*d*, and an indoor fan (not shown) is mounted in the air guide 32. The indoor fan makes the room air to circulate.

There is a discharge guide 34 fitted to the upper part of the air guide 32 for guiding the air passed through the air guide 32 to the discharge opening 15*a*. The discharge guide 34 is in communication with the discharge grill 18.

Next, in the outdoor part, there is a shroud 40 for guiding air flow formed by the outdoor fan 36. The shroud 40 has a lower shroud 40*d* and an upper shroud 40*u*, and has an opening 42 in a central part for mounting the outdoor fan 36 therein.

The shroud 40 is fitted to an outdoor heat exchanger 44. The outdoor heat exchanger 44 makes outdoor air drawn by the outdoor fan 36 to heat exchange with the working fluid in the heat exchange cycle. The reference symbol 46 denotes a compressor, a component of the heat exchange cycle.

In the meantime, there is a curtain assembly 47 for blocking a gap between the unit type air conditioner and the window. The curtain assembly 47 has a curtain frame 48, and a curtain 49.

However, the related art unit type air conditioner has the following problems.

It is required that a space is maintained between the barrier and the shroud. This is because spaces are required for driving motors for the indoor fan and the outdoor fan respectively, the compressor, and pipelines for the working fluid. Moreover, spaces are required for introduction of the outdoor air drawn through opposite sides of the cabinet into the opening in the shroud.

However, the barrier and the shroud, relatively high, have upper parts liable to move by an external force. The movements of the upper parts of the barrier and the shroud are liable to make interference with components around the barrier and the shroud, to cause damage to the components. For an example, if the shroud is fluid during transportation of the product, the outdoor fan and the outdoor heat exchanger interfere, resulting in damage to the outdoor fan and the outdoor heat exchanger.

Moreover, the frame, the cabinet, and the cover are fastened together, and the cabinet is fastened to the base plate to form an exterior of the unit type air conditioner. However, the components forming the exterior, such as the frame, the cabinet, the cover, and the like, and the components on the base plate are not fastened. Therefore, if an external force is applied to the components of the exterior of the air conditioner, relative fluidity taken place between other components on the base plate and the components of the exterior damages the components. For an example, the projected opposite ends of the frame interfere with the indoor heat exchanger and the air guide, to damage the components.

SUMMARY OF THE INVENTION

Accordingly, the present invention is directed to a unit type air conditioner that substantially obviates one or more of the problems due to limitations and disadvantages of the related art.

An object of the present invention is to provide a unit type air conditioner of which fastening state is more rigid.

Another object of the present invention is to provide a unit type air conditioner of which fastening strength is enhanced.

Additional features and advantages of the invention will be set forth in the description which follows, and in part will be apparent to those having ordinary skill in the art upon examination of the following or may be learned from practice of the invention. The objectives and other advantages of the invention will be realized and attained by the structure particularly pointed out in the written description and claims hereof as well as the appended drawings.

To achieve these objects and other advantages and in accordance with the purpose of the present invention, as embodied and broadly described herein, the unit type air conditioner includes a base plate forming a bottom part thereof, a barrier projected upward from a center part of the base plate, to divides the unit type air conditioner into an indoor part for mounting an indoor heat exchanger thereon and an outdoor part for mounting an outdoor heat exchanger thereon, a shroud for leading air drawn from an outdoor to the outdoor heat exchanger, the shroud dividing an inside of the outdoor part, exterior members including a cabinet surrounding opposite side parts and rear side part of he outdoor part, and a cover on the cabinet to form an upper exterior of the outdoor part, and a brace fastened to the barrier, the shroud, and the exterior members, for preventing relative positional change between the barrier, the shroud, and the external members.

The barrier is formed as one unit with the base plate of plastic. The barrier includes a first mounting plate projected from a side thereof toward the shroud, the shroud includes a second mounting plate projected from a top of the shroud toward the barrier, and the brace is fastened to the first mounting part, the second mounting part, and the cover.

In other aspect of the present invention, there is provided a unit type air conditioner including a base plate forming a bottom part thereof, a barrier projected upward from a center part of the base plate, to divides the unit type air conditioner into an indoor part for mounting an indoor heat exchanger thereon and an outdoor part for mounting an outdoor heat exchanger thereon, a shroud for leading air drawn from an outdoor to the outdoor heat exchanger, the shroud dividing an inside of the outdoor part, exterior members including a cabinet surrounding opposite side parts and rear side part of he outdoor part, and a cover on the cabinet to form an upper exterior of the outdoor part, a first mounting plate projected from a side thereof toward the shroud, a second mounting plate projected from a top of the shroud toward the barrier, a first brace having a first fastening part for fastening to the first mounting plate, and a second fastening part for fastening to the second mounting part, and a second brace having a lower fastening piece for fastening to the first fastening part, and an upper fastening piece for fastening to the cover.

The base plate includes a plurality of the first mounting plates formed thereon at regular intervals, and the first brace is sloped from the first fastening part to the second fastening part.

The first brace includes a central opening, and beads on opposite side parts of the central opening for reinforcing.

The second brace includes a rectangular plate part, a lower fastening piece bent at a right angle from a bottom of the plate part for fastening to the first fastening part, with the lower fastening piece seated on a top of the first fastening part, and an upper fastening piece bent at a right angle from a top of the plate part for fastening to an underside of the cover.

The second mounting plate includes first guide parts on outer sides, and a first guide part projected from a center part higher than the first guide parts, and the second fastening part includes guide pieces on outer parts for fastening to the first guide parts, with the guides pieces seated on top surfaces of the first guide parts, and a fastening piece for fastening to the second guide part, with the fastening piece seated on an underside of the second guide part.

In another aspect of the present invention, there is provided a unit type air conditioner including a base plate forming a bottom part thereof, a barrier projected upward from a center part of the base plate, to divides the unit type air conditioner into an indoor part for mounting an indoor heat exchanger thereon and an outdoor part for mounting an outdoor heat exchanger thereon, a shroud for leading air drawn from an outdoor to the outdoor heat exchanger, the shroud dividing an inside of the outdoor part, exterior members including a cabinet surrounding opposite side parts and rear side part of he outdoor part, and a cover on the cabinet to form an upper exterior of the outdoor part, a first mounting plate projected from a side thereof toward the shroud, a second mounting plate projected from a top of the shroud toward the barrier, a brace including a main frame having a first fastening part at one end thereof for fastening to the first mounting plate, and a second fastening part at the other end thereof for fastening to the second mounting part, and a bracket in a central part of the main frame for fastening to the cover.

The bracket is formed as one unit with the main frame, and the base plate includes a plurality of the first mounting plates formed thereon at regular intervals.

The main frame is sloped from the first fastening part to the second fastening part, and the main frame includes a central opening, and beads on opposite side parts of the central opening for reinforcing.

The bracket is extended from one end of the central opening, and an upper part of the cover is fastened to a lower part of the cover.

In further aspect of the present invention, there is provided a unit type air conditioner including a base plate forming a bottom part thereof, a barrier projected upward from a center part of the base plate, to divides the unit type air conditioner into an indoor part for mounting an indoor heat exchanger thereon and an outdoor part for mounting an outdoor heat exchanger thereon, a shroud for leading air drawn from an outdoor to the outdoor heat exchanger, the shroud dividing an inside of the outdoor part, a cabinet formed as one unit with a cover to form an upper exterior of the outdoor part to surround opposite side parts and a rear side part of the outdoor part, and a brace fastened to the barrier, the shroud, and the cabinet, for preventing relative positional changes of the barrier, the shroud, and the cabinet.

It is to be understood that both the foregoing description and the following detailed description of the present invention are exemplary and explanatory and are intended to provide further explanation of the invention claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE PREFERRED EMBODIMENT

Reference will now be made in detail to the preferred embodiments of the present invention, examples of which are illustrated in the accompanying drawings. In describing the embodiments, same parts will be given the same names and reference symbols, and repetitive description of which will be omitted.

Figure 1:
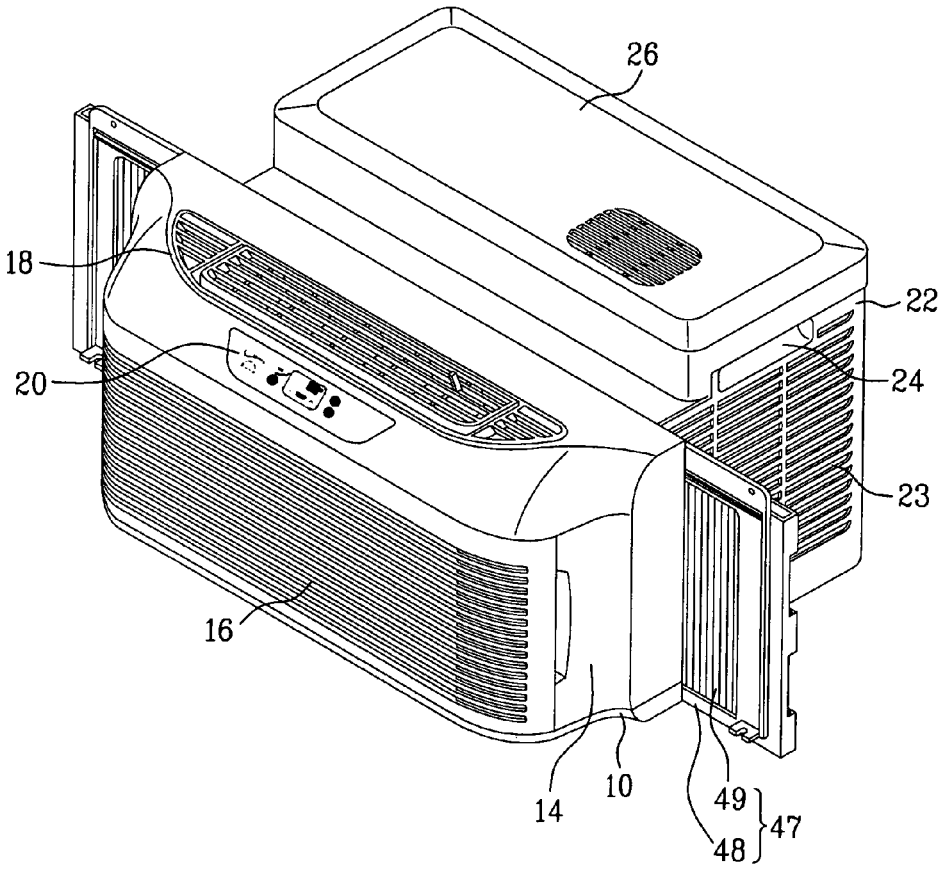
FIG. 1 Prior Art
FIG. 1 illustrates a perspective view of a related art unit type air conditioner.
Figure 2:
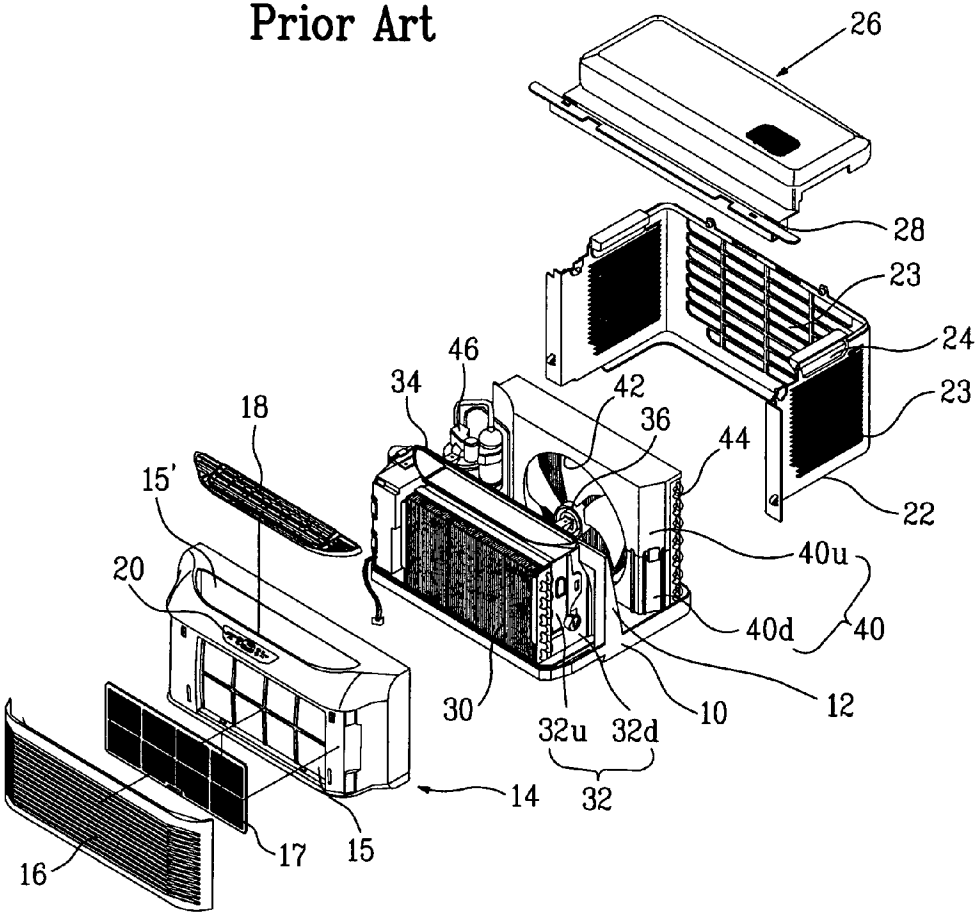
FIG. 2 Prior Art
FIG. 2 illustrates a disassembled perspective view of a related art unit type air conditioner.
Figure 3:
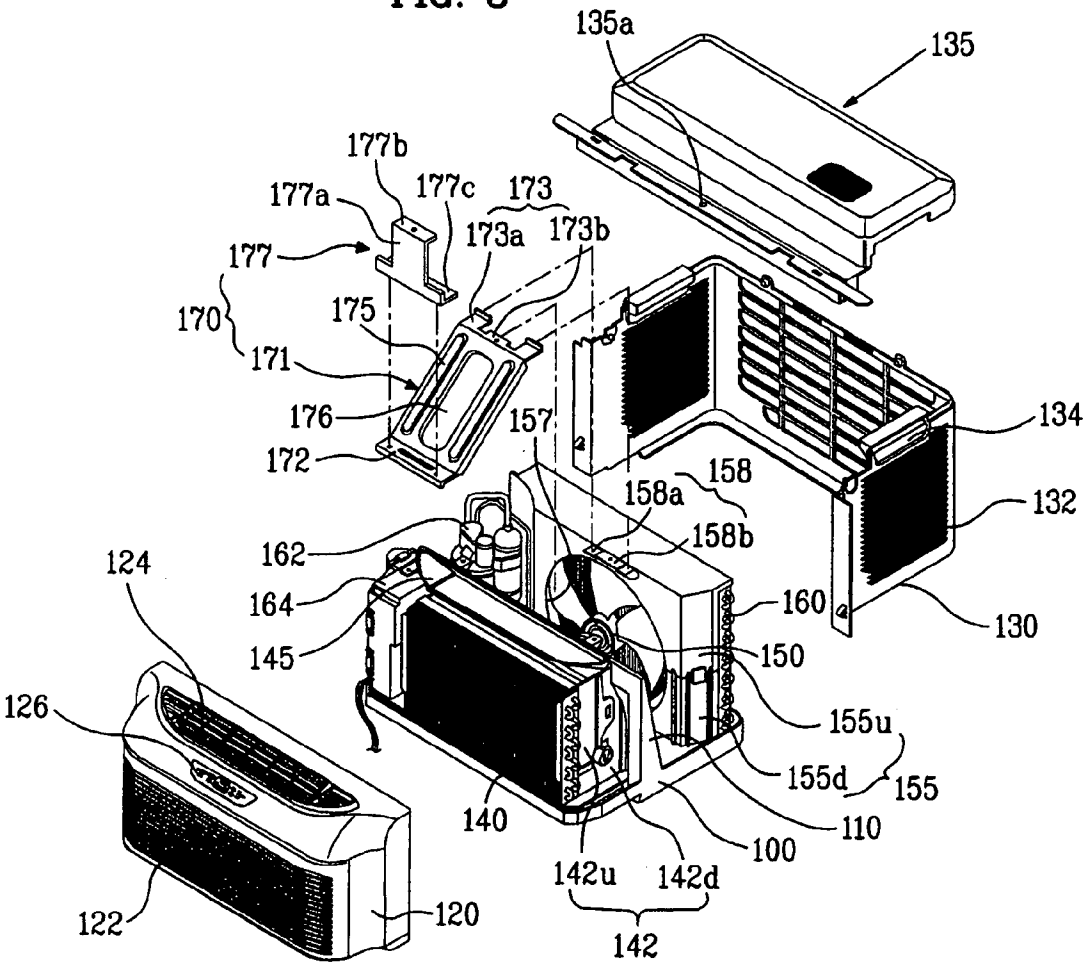
FIG. 3 illustrates a disassembled perspective view of a unit type air conditioner in accordance with a first preferred embodiment of the present invention.
Figure 4:
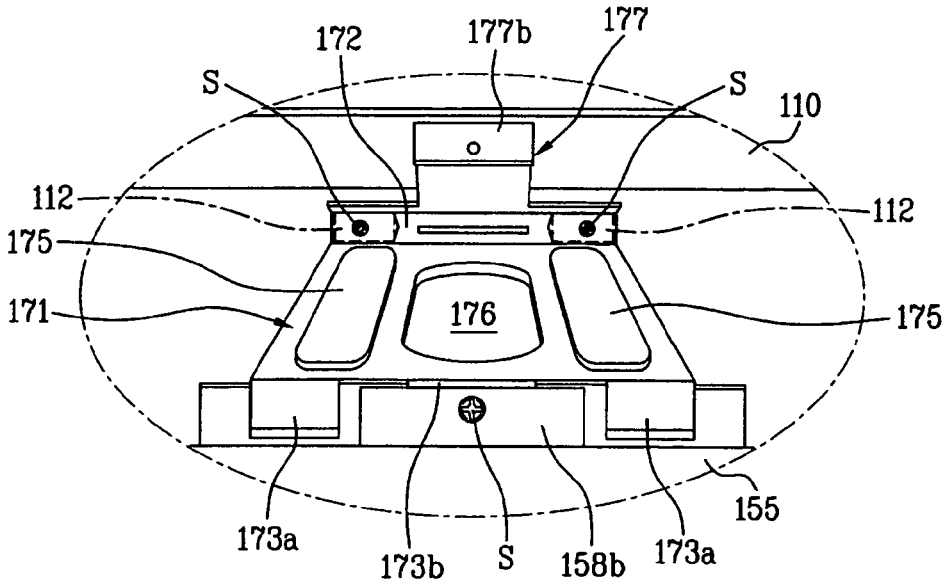
FIG. 4 illustrates a perspective view of a brace fastening structure in accordance with a first preferred embodiment of the present invention.

FIG. 3 illustrates a disassembled perspective view of a unit type air conditioner in accordance with a first preferred embodiment of the present invention, and FIG. 4 illustrates a perspective view of a brace fastening structure in accordance with a first preferred embodiment of the present invention.

Referring to FIGS. 3 and 4, there is a base plate 100 in a bottom part of the air conditioner, having various components provided thereon. The base plate 100 is substantially rectangular, and has a barrier 110 projected upward from a center part thereof.

The barrier 110 divides the unit type air conditioner into an indoor part and an outdoor part. The base plate 100 is formed by injection molding of plastic, preferably, together with the base plate 100 as one unit.

There are a frame 120 in a front part of the unit type air conditioner, and an inlet grill in front of the frame 120. The inlet grill 122 passes air drawn into the air conditioner, and there is an air filter in rear of the inlet grill 122 for cleaning the air.

There is a discharge grill 124 fitted to an upper part of the frame 120. The discharge grill 124 discharges the air heat exchanged in the air conditioner to the room. There is a display part 126 between the inlet grill 122 and the discharge grill 124 on the frame 120.

There is a cabinet 130 to surround opposite sides and a rear side of the outdoor part of the air conditioner. The cabinet 130 has a plurality of openings 132 for air inlet/outlet. The openings 132 serve as passages for the air drawn into/discharged from the outdoor part. Accordingly, outdoor air is drawn into the outdoor part through the openings 132 in the opposite sides of the cabinet 130, the air is discharged from the outdoor part to the outdoor through the opening 132 in the rear side thereof. There are recesses 134 in opposite side parts of the cabinet 130 for holding the air conditioner for transportation.

The cabinet 130 is fastened to the base plate 100 and the frame 120. There is a cover 135 on the cabinet 130, to form an upper exterior of the outdoor part. The cover 135 may be formed as one unit, and has fastening holes 135*a* for fastening to a brace 170 to be described later with screws.

In the meantime, there is an indoor heat exchanger 140 in the indoor part. The indoor heat exchanger 140 is fastened to the air guide 142 having an upper air guide 142*u* and a lower air guide 142*d*. There is an indoor fan (not shown) mounted in the air guide 142.

There is a discharge guide 145 on the air guide 142 for guiding the air passed through the air guide 142 to a discharge grill 124. The discharge guide 145 is in communication with the discharge grill 124.

Meanwhile, in the outdoor part, there are a driving motor (not shown) for operating the indoor fan and an outdoor fan 150. The driving motor has a rotation shaft projected in both directions, of which one passes through the barrier 110, and is extended to an inside of the air guide 142.

There is a shroud 155 on the base plate 100 to divide an inside of the outdoor part. The shroud 155 has a lower shroud 155*d* and an upper shroud 155*u*, and guides the outdoor air drawn through openings 132 in the opposite side parts of the cabinet 130 to the outdoor heat exchanger 160. The shroud 155 has a central opening 157, for mounting the outdoor fan 150 therein.

The barrier 110, the shroud 155, and the cover 135 are fastened to a brace 170. To do this, the barrier 110 has a first mounting plate 112 projected from one side of the barrier 110. There may be a plurality of first mounting plates 112 at regular intervals, or one long first mounting plate 112. It is preferable that the first mounting plate 112 is formed as one unit with the barrier 110. The first mounting plate 112 may be formed on the base plate 100 between the barrier 110 and the shroud 155.

There is a second mounting plate 158 projected from a top of the shroud toward the barrier 110. The second mounting plate 158 is extended in a lateral direction from a part at the top of the shroud 155, and has first guide parts 158*a* at opposite ends of an upper surface, and a second guide part 158*b* in a central part thereof. The second guide part 158*b* is projected upward higher than the first guide parts 158*a*.

The first and second mounting plates 112 and 158 are fastened to the brace 170.

Figure 5:
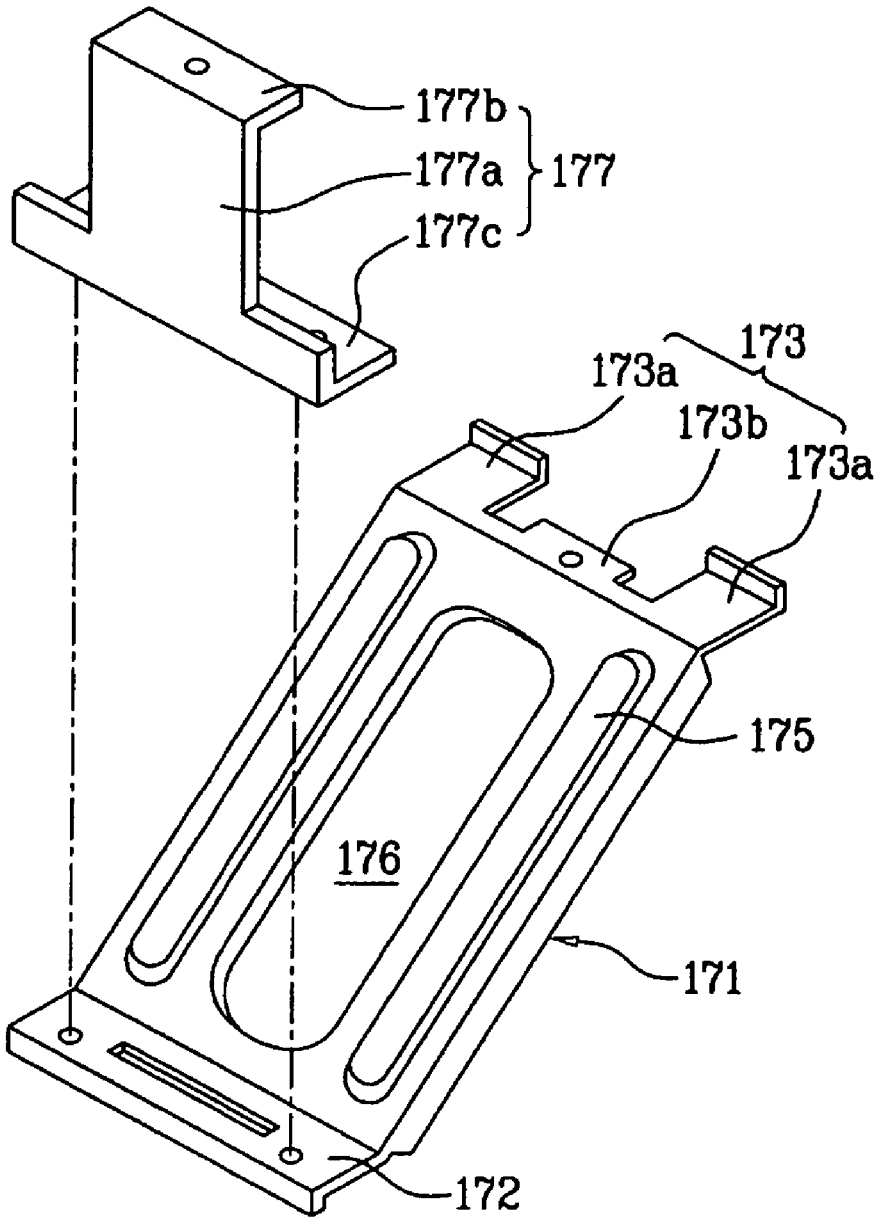
FIG. 5 illustrates a perspective view of a brace in accordance with a first preferred embodiment of the present invention.

The brace 170 will be described in more detail. FIG. 5 illustrates a perspective view of a brace in accordance with a first preferred embodiment of the present invention.

Referring to FIG. 5, the brace in accordance with a first preferred embodiment of the present invention includes a first brace 171 and a second brace 177. The first brace 171 includes one end having a first fastening part 172 for fastening to the first mounting plate 112, and the other end having a second fastening part 173 for fastening to the second mounting plate 158. The second brace 177 includes a lower fastening piece 177*c* for fastening to the first fastening part 172, and an upper fastening piece 177*b* for fastening to the cover 135.

The first fastening part 172 is fastened to the first mounting plate 112 and the lower fastening piece 177*c* together, with the first fastening part 172 seated on a top surface of the first mounting plate 112, and a bottom surface of the lower fastening pieces 177*c*. To do this, the first fastening part 172, the first mounting plate 112, and the lower fastening piece 177*c* have fastening holes for fastening with screws 's'.

In the meantime, the second fastening part 173 has outer guide pieces 173*a* and a center fastening piece 173*b*, for fastening to the second mounting plate 158. That is, the guide pieces 173*a* is fastened to the first guide parts 158*a*, with the guide pieces 173*a* seated on a top surface of the first guide parts 158*a*, and the fastening piece 173*b* is fastened to the second guide part 158*b*, with the fastening piece 173*b* seated on a bottom surface of the second guide part 158. The second guide part 158*b* and the fastening piece 173*b* have fastening holes for fastening with screws 's'.

Since the first brace 171 is fastened to the first and second mounting plates 112 and 158 at different heights, the first brace 171 is sloped upward from the first fastening part 172 to the second fastening part 173. The first brace 171 has an opening 176 in a central part, and beads 175 on sides of the opening 176 for reinforcing.

The second brace 177 will be described in more detail. The second brace 177 includes a rectangular plate part 177*a*, and the upper, and lower fastening pieces 177*b* and 177*c* on top and bottom of the plate part 177*a*, respectively.

The lower fastening piece 177*c*, bent at a right angle from the bottom of the plate part 177*a*, is fastened to the first fastening part 172, with the lower fastening piece 177*c* seated on the first fastening part 172. The upper fastening piece 177*b*, bent at a right angle from the top of the plate part 177*a*, is fastened to the cover 135, with the upper fastening piece 177*b* seated on an underside thereof.

As described, the lower fastening piece 177*c* has fastening holes for fastening to the first fastening part 172 with screws. The fastening holes in the lower fastening piece 177*c* are formed at positions corresponding to the fastening holes in the first fastening part 172. The lower fastening piece 177*c*, and the first fastening part 172 are fastened to the first mounting plate 112 with screws 's'. The upper fastening piece 177*b*, and the cover 135 also have fastening holes at corresponding positions for screw fastening.

In the drawing, the unexplained reference symbol 162 denotes a compressor, and 164 denotes a control box for controlling operation of the air conditioner.

An assembly process of the unit type air conditioner in accordance with a first preferred embodiment of the present invention will be described.

In a state the base plate 100 has components of the air conditioner mounted thereon, the barrier 110 and the shroud 155 are connected with the brace 171. To do this, the first fastening part 172 is positioned on the first mounting plate 112, and the guide piece 173*a* is positioned on the first guide parts 158*a*. In this instance, the fastening piece 173*b* of the second fastening part 173 is made to position under the second guide part 158*b*. Moreover, the fastening holes both in the fastening piece 173*b* and the second guide part 158*b* are aligned, too.

Then, the lower fastening piece 177*c* of the second brace 177 is positioned on the first fastening part 172. In this instance, it is required that the fastening holes in the lower fastening piece 177*c*, and the fastening holes in the first fastening part 172 are aligned.

Then, screws 's' are fastened to the first mounting plate 112 through the fastening holes in the lower fastening piece 178 and the first fastening piece 172. Of course, the second fastening part 173 may be fastened to the second mounting plate 158 with screws 's' before the first mounting plate 112 is fastened with screws 's'.

Once the barrier 110 and the shroud 155 are connected with the first and second braces 171 and 177, a distance between the barrier 110 and the shroud 155 is always kept constant.

Meanwhile, after finishing assembly of components of the air conditioner, the cover 135 is closed, and the upper fastening piece 177*b* of the second brace 177 and the cover 135 are fastened. That is, the fastening holes in the upper fastening piece 177*b* and the fastening holes 135*a* in the cover 135 are aligned, and fastened with screws. Then, the brace 170 is fastened to the barrier 110, the shroud 155, and the cover 135, to prevent relative positional change between them.

In the meantime, the second brace may be fastened, not to the cover 135, but to other exterior components, i.e., to the cabinet 130. Moreover, shapes and structures of the first and second mounting plates 112 and 158 may vary with the same of the brace 170. That is, since the first and second mounting plates 112 and 158 are fastened to the brace 170, if the structure of the brace 170 is changed the same as the following second embodiment, the structures of the mounting plates 112 and 158 are also changed.

Figure 6:
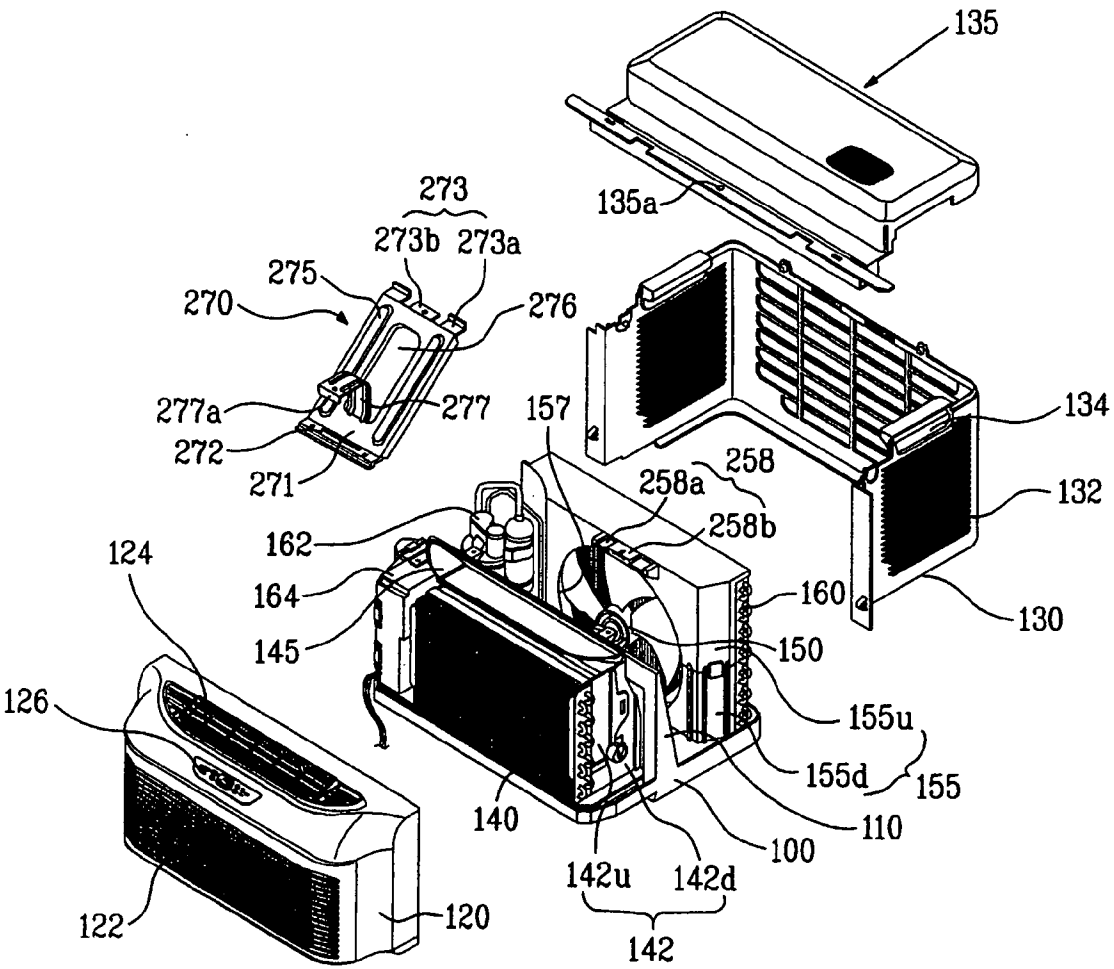
FIG. 6 illustrates a disassembled perspective view of a unit type air conditioner in accordance with a second preferred embodiment of the present invention.

A unit type air conditioner in accordance with a second preferred embodiment of the present invention will be described. FIG. 6 illustrates a disassembled perspective view of a unit type air conditioner in accordance with a second preferred embodiment of the present invention, and FIG. 7 illustrates a perspective view of a brace fastening structure in accordance with a second preferred embodiment of the present invention.

Figure 7:
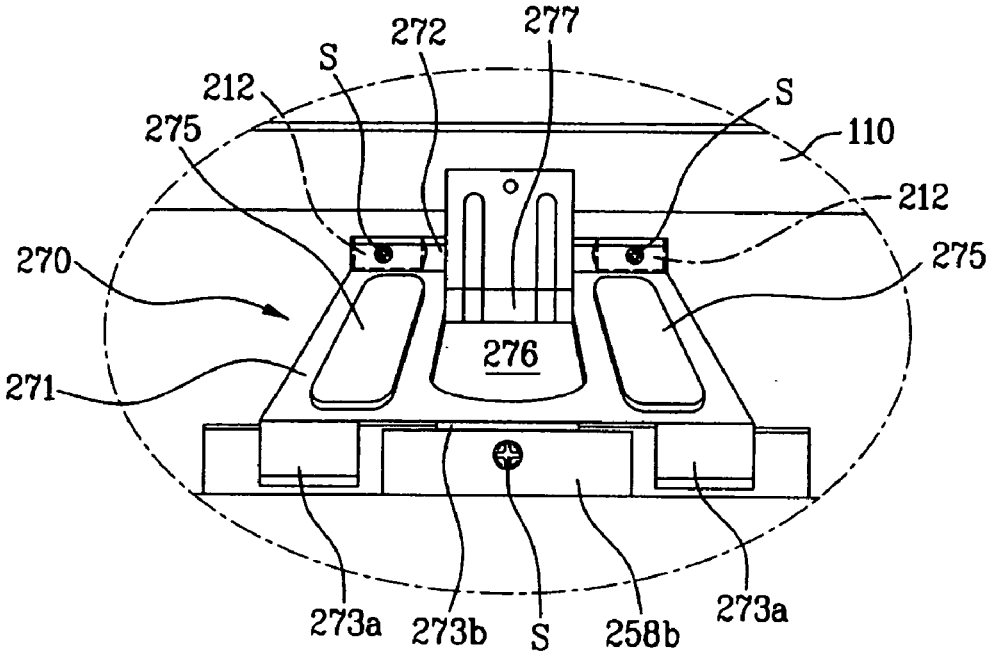
FIG. 7 illustrates a perspective view of a brace fastening structure in accordance with a second preferred embodiment of the present invention.

Referring to FIGS. 6 and 7, there is a base plate 100 in a bottom part of the air conditioner, having various components provided thereon. The base plate 100 is substantially rectangular, and has a barrier 110 projected upward from a center part thereof.

There is a first mounting plate 212 projected from a side of the barrier 110 toward a shroud 155. There is a second mounting plate 258 projected from a top part of the shroud 155 toward the barrier 110. The second mounting plate 258 is extended in lateral direction from the top part of the shroud 155, has guide parts 258*a* in outer parts. The second mounting plate 258 has a slot 258*b* in a center part.

Figure 8:
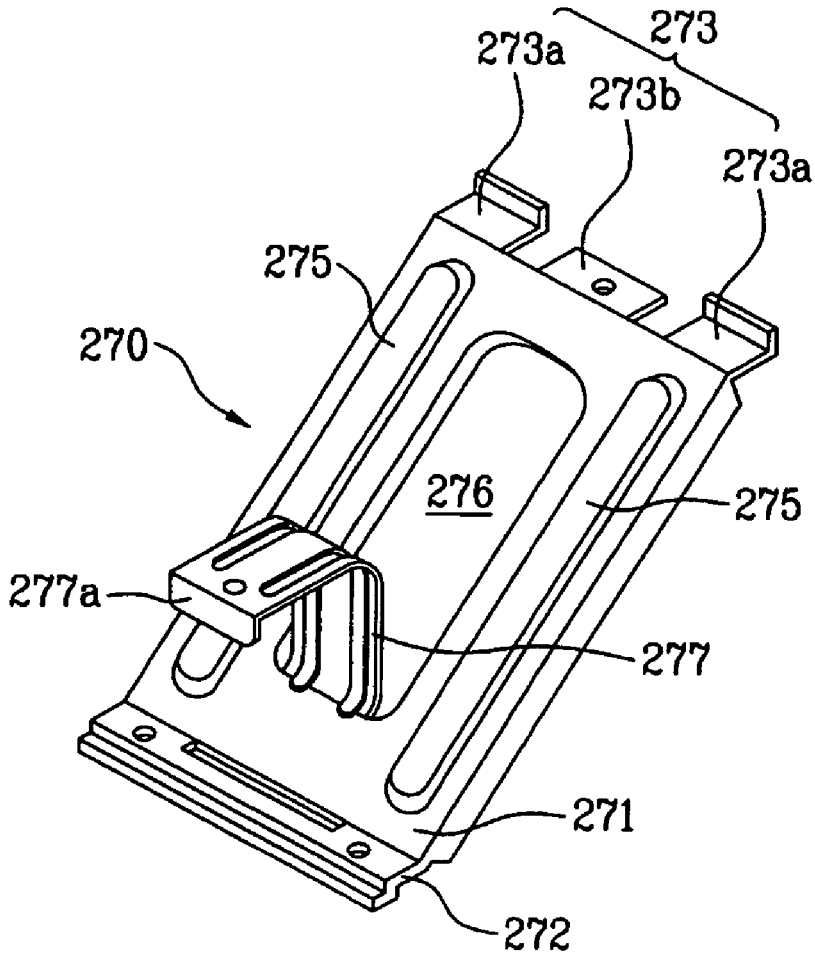
FIG. 8 illustrates a perspective view of a brace in accordance with a second preferred embodiment of the present invention.

The first and second mounting plates 212 and 258 are fastened to a brace 270. The brace 270 will be described in more detail. FIG. 8 illustrates a perspective view of a brace in accordance with a second preferred embodiment of the present invention, and FIG. 9 illustrates a section of the brace in FIG. 8 along a lengthwise center line thereof.

Figure 9:
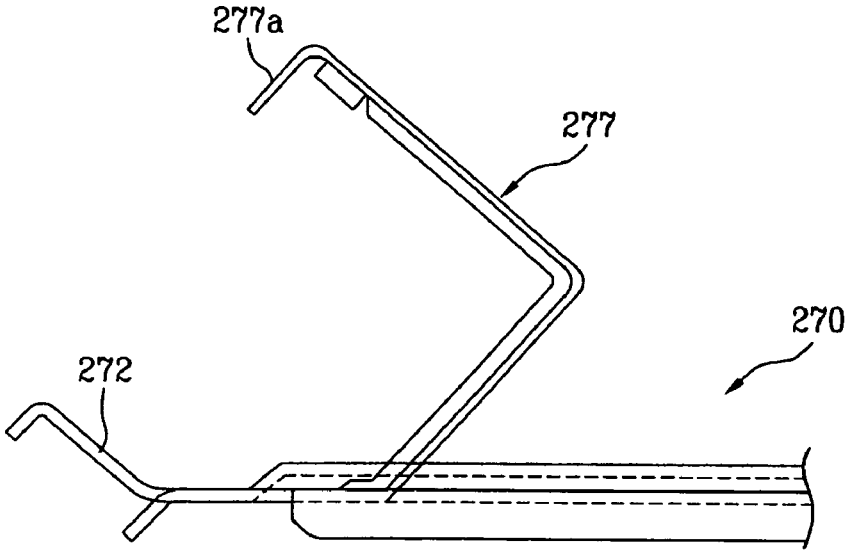
FIG. 9 illustrates a section of the brace in FIG. 8 along a lengthwise center line thereof.

Referring to FIGS. 8 and 9, the brace 270 includes a main frame 271 and a bracket 277.

The main frame 271 includes one end having a first fastening part 272 for fastening to the first mounting plate 212, and the other for fastening to the second mounting plate 258. The bracket 277, in a center part of the main frame 271, is fastened to the cover 135. It is preferable that the bracket 277 is formed as one unit with the main frame 271.

The first fastening part 272 is seated on a top surface of the first mounting plate 212, for which the first fastening part 272 and the first mounting plate 212 have fastening holes for fastening with screws 's'.

In the meantime, the second fastening part 273 has guide pieces 273*a* on outer sides, and a fastening piece 273*b* in a center part. The second mounting plate 258 for fastening to the second fastening part 273 has the guide parts 258*a* on outer parts thereof for fastening to the guide piece 273*a*, and a slot 258*b* in a center part thereof the fastening piece 273*b* is inserted therein. According to this, the guide piece 273*a* is seated on the top surface of the guide parts 258*a*, and the fastening piece 273*b* is inserted in the slot 258*b*. There are fastening holes in a top surface of the slot 258*b* and the fastening piece 273*b* for fastening the second fastening part 273 and the second mounting part 258 with screws 's'.

In the meantime, since the main frame 271 is fastened to the first and second mounting plates 212 and 258 at different heights, the main frame 271 is sloped upward from the first fastening part 272 to the second fastening part 273. The main frame 271 has a central opening 276, and beads 275 on both sides of the opening 276.

It is preferable that the bracket 277 is extended from one end of the opening 276. That is, the bracket 277 is extended upward from one end of the opening 276, bent vertically to be parallel to the first fastening part 272, so that an upper part of the bracket fastens to the cover 135.

In the meantime, the bracket 277 has a reinforcing piece 277*a* at an end thereof. The reinforcing piece 277*a* is bent at an angle from the end of the bracket 277 particularly, it is preferable that the reinforcing piece 277*a* is bent vertically. There are fastening holes in the upper part of the bracket 277 and the cover 135. The bracket 277 may be formed by cutting, and opening a part of the main frame 271.

Figure 10A:
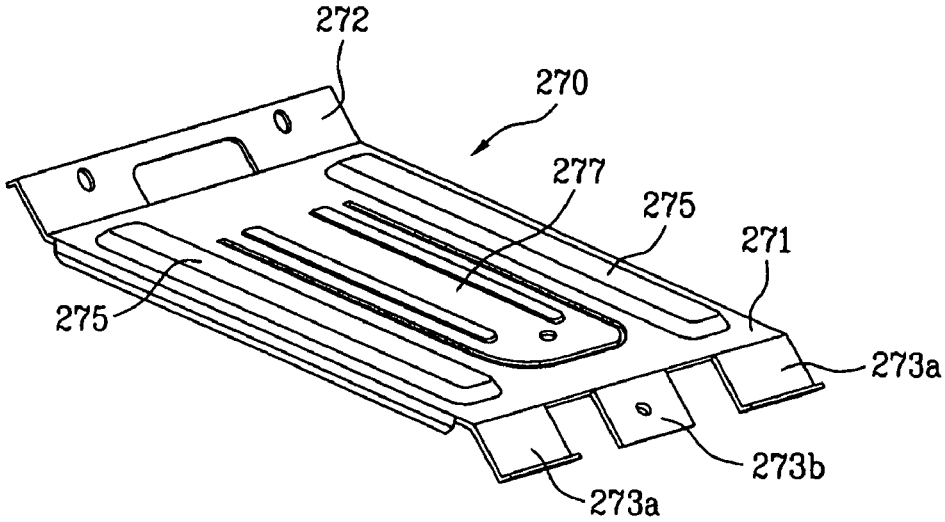
FIGS. 10A and 10B illustrate perspective views each showing the steps of a process for fabricating a bracket on the brace in accordance with a second preferred embodiment of the present invention.
Figure 10B:
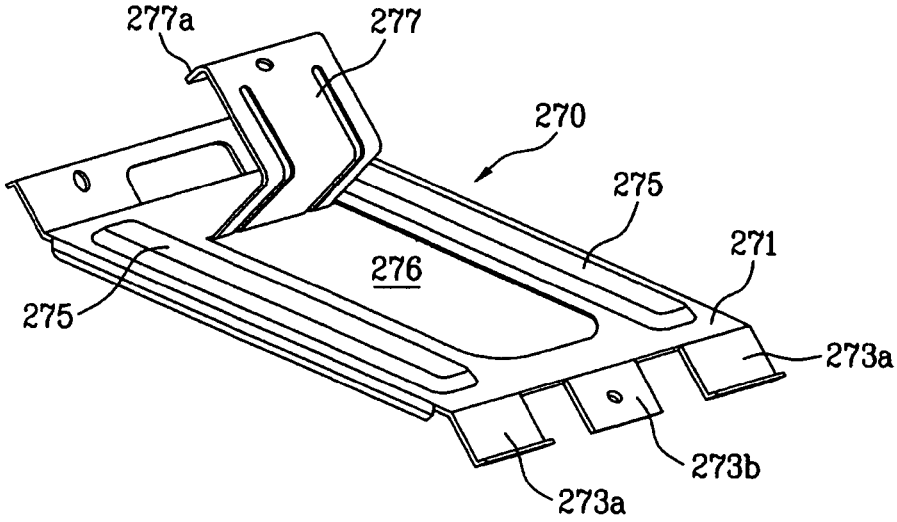

FIGS. 10A and 10B illustrate perspective views each showing the steps of a process for fabricating a bracket on the brace in accordance with a second preferred embodiment of the present invention.

Referring to FIGS. 10A and 10B, the central part of the main frame 271 is cut according to a dimension of the bracket 277, partly. In this instance, a part adjoining to the first fastening part 272 is not cut, to leave in a state the part is connected to the main frame 271. The cutting may be carried out simply by punching. Next, the cut part is pulled until the cut part has at an angle from the main frame 277, and a center part and an end thereof are bent, to form the bracket 277.

An assembly process of the unit type air conditioner in accordance with a second preferred embodiment of the present invention will be described.

In a state components of the unit type air conditioner are mounted on the base plate 100, the barrier 110 and the shroud 155 are connected with the main frame 271. To do this, the first fastening part 272 is positioned on the first mounting plate 212, and respective fasting holes are aligned. Moreover, the guide piece 273*a* is positioned on the guide part 258*a* of the second mounting plate 258. In this instance, the fastening piece 273*b* is inserted in the slot 258*b*, and the fastening holes in the fastening piece 273*b* and the slot 256*b* are aligned.

Then, screws 's' are fastened to the first mounting plate 212 through the fastening holes in the first fastening part 272. Of course, screws 's' may be fastened to the second mounting plate 258 before the screws 's' are fastened to the first mounting plate 212.

Once the barrier 110 and the shroud 155 are connected with the main frame 271, a distance between the barrier 110 and the shroud 155 can be kept constant.

In the meantime, after the assembly of the components of the air conditioner is finished, and putting the cover 135 on, the bracket 277 and the cover 135 are fastened. That is, the fastening hole in the bracket 277 and the fastening hole 135*a* in the cover 135 are aligned, and fastened with a screw 's'. At the end, the brace 270 fastens the barrier 110, the shroud 155, and the cover 135, to prevent relative positional change between them.

In the meantime, the bracket 277 may be fastened, not to the cover 135, but other exterior member, i.e., to the cabinet 130. Shapes and structures of the first and second mounting plates 212 and 258 may also vary with the same of the brace 270.

As has been described, the unit type air conditioner of the present invention has the following advantages.

First, the brace, fastening the barrier, the shroud, and the cover together, prevents interferences between components coming from fluidity.

Second, the brace, fastening inside components to the exterior members, such as the cover, together, enhances fastening strength between components because the fastening between the components in the air conditioner becomes rigid.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. An air conditioner comprising:

a base plate forming a bottom part thereof;

a barrier which projects in an upward direction from a center part of the base plate, the barrier dividing the air conditioner into an indoor part for mounting an indoor heat exchanger thereon and an outdoor part for mounting an outdoor heat exchanger thereon;

a shroud for leading air drawn from outside the air conditioner to the outdoor heat exchanger, the shroud dividing an inside of the outdoor part;

exterior members including a cabinet surrounding opposite side parts and a rear part of the outdoor part, and a cover on the cabinet to form an upper exterior of the outdoor part; and a brace fastened to the barrier, the shroud, and the exterior members, for preventing relative positional change between the barrier, the shroud, and the external members.

2. The air conditioner as claimed in claim 1, wherein the baffler is formed as one unit with the base plate of plastic.

3. The air conditioner as claimed in claim 1, wherein the barrier includes a first mounting plate which projects from a side thereof toward the shroud, the shroud includes a second mounting plate which projects from a top of the shroud toward the barrier, and the brace is fastened to the first mounting part, the second mounting part, and the cover.

4. An air conditioner comprising:

a base plate forming a bottom part thereof;

a barrier which in an upward direction from a center part of the base plate, to divides the unit type air conditioner into an indoor part for mounting an indoor heat exchanger thereon and an outdoor part for mounting an outdoor heat exchanger thereon;

a shroud for leading air drawn from outside the air conditioner to the outdoor heat exchanger, the shroud dividing an inside of the outdoor part;

exterior members including a cabinet surrounding opposite side parts and a rear part of the outdoor part, and a cover on the cabinet to form an upper exterior of the outdoor part;

a first mounting plate which projects from a side thereof toward the shroud, a second mounting plate which projects from a top of the shroud toward the barrier; a first brace having a first fastening part for fastening to the first mounting plate, and a second fastening part for fastening to the second mounting part; and a second brace having a lower fastening piece for fastening to the first fastening part, and an upper fastening piece for fastening to the cover.

5. The air conditioner as claimed in claim 4, wherein the base plate includes a plurality of the first mounting plates formed thereon at regular intervals.

6. The air conditioner as claimed in claim 4, wherein the first brace is sloped from the first fastening part to the second fastening part.

7. The air conditioner as claimed in claim 6, wherein the first brace includes:

a central opening; and beads on opposite side parts of the central opening for reinforcing.

8. The air conditioner as claimed in claim 4, wherein the second brace includes:

a rectangular plate part;

a lower fastening piece bent at a right angle from a bottom of the plate part for fastening to the first fastening part with the lower fastening piece seated on a top of the first fastening part; and an upper fastening piece bent at a right angle from a top of the plate part for fastening to an underside of the cover.

9. The air conditioner as claimed in claim 4, wherein the second mounting plate includes first guide parts on outer sides, and a first guide part which projects from a center part higher than the first guide parts, and the second fastening part includes guide pieces on outer parts for fastening to the first guide parts, with the guides pieces seated on top surfaces of the first guide parts, and a fastening piece for fastening to the second guide part, with the fastening piece seated on an underside of the second guide part.

10. An air conditioner comprising:

a base plate forming a bottom part thereof;

a barrier which projects in an upward direction from a center part of the base plate to divide the unit type air conditioner into an indoor part for mounting an indoor heat exchanger thereon and an outdoor part for mounting an outdoor heat exchanger thereon;

a shroud for leading air drawn from outside the air conditioner to the outdoor heat exchanger, the shroud dividing an inside of the outdoor part;

exterior members including a cabinet surrounding opposite side parts and rear side part of the outdoor part, and a cover on the cabinet to form an upper exterior of the outdoor part;

a first mounting plate which projects from a side thereof toward the shroud, a second mounting plate which projects from a top of the shroud toward the barrier; and a brace including:

a main frame having a first fastening part at one end thereof for fastening to the first mounting plate, and a second fastening part at the other end thereof for fastening to the second mounting part; and a bracket in a central part of the main frame for fastening to the cover.

11. The air conditioner as claimed in claim 10, wherein the bracket is formed as one unit with the main frame.

12. The air conditioner as claimed in claim 10, wherein the base plate includes a plurality of the first mounting plates formed thereon at regular intervals.

13. The air conditioner as claimed in claim 10, wherein the main frame is sloped from the first fastening part to the second fastening part.

14. The air conditioner as claimed in claim 13, wherein the main frame includes:

a central opening; and beads on opposite side parts of the central opening for reinforcing.

15. The air conditioner as claimed in claim 14, wherein the bracket extends from one end of the central opening, and an upper part of the cover is fastened to a lower part of the cover.

16. An air conditioner comprising:

a base plate forming a bottom part thereof;

a barrier which projects in an upward direction from a center part of the base plate to divide the unit type air conditioner into an indoor part for mounting an indoor heat exchanger thereon and an outdoor part for mounting an outdoor heat exchanger thereon;

a shroud for leading air drawn from outside the air conditioner to the outdoor heat exchanger, the shroud dividing an inside of the outdoor part;

a cabinet formed as one unit with a cover to form an upper exterior of the outdoor part to surround opposite side parts and a rear side part of the outdoor part; and a brace fastened to the barrier, the shroud, and the cabinet, for preventing relative positional changes of the barrier, the shroud, and the cabinet.

* * * * *